US006733834B1

(12) United States Patent
Bellmann et al.

(10) Patent No.: US 6,733,834 B1
(45) Date of Patent: May 11, 2004

(54) PROCESS FOR THE MANUFACTURE OF SOFT TIPPED BLADES

(75) Inventors: Günter Bellmann, Commugny (CH); Silvano Freti, St. Prex (CH); André Gerber, Prangins (CH)

(73) Assignee: ETG Eclepens S.A., Eclepēns (CH)

( * ) Notice: Subject to any disclaimer, the term of this patent is extended or adjusted under 35 U.S.C. 154(b) by 0 days.

(21) Appl. No.: 09/913,593

(22) PCT Filed: Feb. 8, 2000

(86) PCT No.: PCT/EP00/00977

§ 371 (c)(1),
(2), (4) Date: Aug. 30, 2001

(87) PCT Pub. No.: WO00/48746

PCT Pub. Date: Aug. 24, 2000

(30) Foreign Application Priority Data

Feb. 18, 1999 (SE) ..... 9900564

(51) Int. Cl.[7] ..... B05D 3/12

(52) U.S. Cl. ..... 427/289; 427/322; 427/327; 427/385.5; 427/387; 427/407.1

(58) Field of Search ..... 427/385.5, 387, 427/289, 407.1, 327, 322

(56) References Cited

U.S. PATENT DOCUMENTS 6,040,018 A * 3/2000 Lamers ..... 427/510
6,127,034 A * 10/2000 Chorley ..... 428/375
6,462,107 B1 * 10/2002 Sinclair et al. ..... 523/456
6,494,977 B1 * 12/2002 Waldenberger et al. ..... 156/78

FOREIGN PATENT DOCUMENTS

EP 0 369 181 A2 5/1990

* cited by examiner

*Primary Examiner*—Bernard Pianalto
(74) *Attorney, Agent, or Firm*—Burns, Doane, Swecker & Mathis, L.L.P.

(57) ABSTRACT

A process for the manufacture of a coating or doctoring blade comprising a band of steel or other form-stable material and a wear-resistant polymer coating applied on said band along a longitudinal edge section thereof subjected to wear, said process comprising the following steps: (a) providing continuous relative movement between said band and an application and treatment station; (b) continuously applying at said station a fast-curing polymer composition along said edge section; (c) allowing the applied composition to spread out so as to reach the very extreme of said edge section and then to cure to form an elastic and tacky-free coating; and, optionally (d) post-curing the coating at an increased temperature; as an alternative to such process there can be used a blade of double width compared to said first band and continuously supplying a fast-curing composition along a longitudinal central section of double width compared to said edge section and longitudinally cutting said second band along the middle of the coated central section thereof to form two tip-coated blades; and a coating or doctoring blade prepared by such process.

21 Claims, 1 Drawing Sheet

PROCESS FOR THE MANUFACTURE OF SOFT TIPPED BLADES

TECHNICAL FIELD

The present invention relates to processes for the manufacture of coating or doctoring blades comprising a band of steel or other form-stable material and a wear-resistant coating applied onto said band along a longitudinal edge section thereof subject to wear.

BACKGROUND OF THE INVENTION

Coating or doctoring blades tipped with rubbery or soft material are presently prepared only by moulding in a closed mould in which a band of steel or other form-stable material is placed and constitutes substrate for the coating. A liquid mix of components is injected at the lower end of a preheated mould until it appears at the opposite upper end. Care has to be taken to prevent introduction of air bubbles in the liquid material and no leakage from the mould must occur. A demoulding agent, generally based on silicones, is applied on the mould surfaces to prevent sticking of the cured material. Once filled, the mould is introduced into a circulated air oven at 80–110° C. until curing has taken place so that the blades can be demoulded. This takes generally 45 to 180 minutes. After demoulding the blades are post-cured at 80–110° C. for 12–24 hours.

This batch process is associated with several disadvantages, among which the main drawbacks are:

- the process encounters low productivity;
- each new blade geometry and blade length requires a new mould;
- the mould manufacturing costs are high, especially for large moulds with complex profiles;
- the larger the mould, the larger the oven necessary to preheat the mould and to cure the rubbery or soft material, and the higher the pressure necessary to fill the mould;
- there are limitations in blade length because of difficulties in filling the mould without defects occurring, the need for longer pot-lives and lower viscosities, increasing mould weight, time to open, close and clean the mould etc.

For these and other reasons it is desirable to develop a simple and economic continuous process to produce such blades without limitations to length and geometry.

BRIEF SUMMARY OF THE INVENTION

One object of the invention is to provide a continuous process for the manufacture of coating or doctoring blades provided with a wear-resistant soft or rubbery coating.

Another object of the invention is to provide such a process which will impart no limitations to blade length and geometry of the coated blade.

Still another object of the invention is to provide a continuous process which is commercially competitive and flexible to meet consumers specifications.

For these and other objects which will be clear from the following disclosure the invention provides a continuous process for the manufacture of coating or doctoring blades comprising a band of steel or other form-stable material and a wear-resistant polymer coating applied on said band along a longitudinal edge section thereof subjected to wear. The process involves the following steps:

a) providing continuous relative movement between said band and an application and treatment station;

b) continuously applying at said station a fast-curing polymer composition along said edge section;

c) allowing the applied composition to spread out so as to reach the very extreme of said edge section and then to cure to form an elastic and tacky-free coating; and, optionally d) post-curing the coating at an increased temperature.

According to an alternative embodiment of such continuous process the following steps are involved:

a) providing continuous relative movement between a second band of double width compared to said first band and an application and treatment station;

b) continuously supplying at said station a fast-curing composition along a longitudinal central section of double width compared to said edge section;

c) allowing the applied composition to spread out to the desired width and then to cure to form an elastic and tacky-free coating and, optionally, post-curing the coating at an increased temperature; and d) longitudinally cutting said second band along the middle of the coated central section thereof to form two tip-coated blades.

In the process according to the invention it is preferred to introduce before application step b) above a roughening step for said edge or central section to improve the adhesion of the coating.

It is also preferred for further improving the adhesion of the coating to apply a primer before application step b) above.

According to a preferred embodiment of the invention the fast-curing polymer composition has a pot-life of about 5 to about 30 sec.

Among preferred fast-curing polymers there may be mentioned those selected from polyurethanes, styrene-butadien polymers, polyolefins, nitrile rubbers, natural rubbers, polyacrylates, polychloroprene, thermoplastic elstomers, and polysiloxanes. It is particularly preferred to use as a polymer a polyurethane.

A suitable fast-curing polymer composition is a 3-component liquid polyurethane composition containing a prepolymer, a polyol and a chain extender. Such composition is continuously mixed with a catalyst solution, whereafter the mixture is applied onto the band to be coated.

The coating width is preferably from about 5 to about 40 mm and a preferred thickness is from about 1 to about 3 mm.

After curing of the coating it is preferred to subject the coating to a grinding operation to obtain the desired profile or geometry.

BRIEF SUMMARY OF THE DRAWING

The present invention will in the following be described with reference to the appended drawing, wherein.

DETAILED DESCRIPTION OF THE INVENTION

Figure 1:
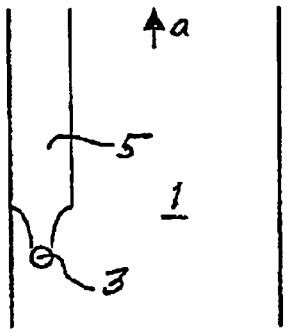
FIG. 1 is a diagrammatic view of a continuously moving band also illustrating the coating to be applied.

A preferred sequence of process steps is described in the following in general terms, but it should be observed that the present invention is not restricted to such steps other than as defined in the accompanying claims.

Step 1. This step involves surface preparation of a cold rolled metallic substrate having a thickness of 0.1 to 1.5 mm, a width of 50 to 200 mm and a length of up to 100 m. The surface area of the blade intended to receive the soft material deposit (edge or centre) is roughened by sand or grit-blasting and optionally thereafter degreased and cleaned. The width of the roughened surface area is between 5 and 40 mm (double these figures for centre deposit).

Step 2. This step is concerned with the deposition of adherend or primer. In order to achieve a good adhesion between the soft material composition and the base substrate application of an intermediate bonding layer is preferred. The solvent or water-borne adherend or primer solution is applied on top of the sand or grit-blasted surface area by anyone of the following methods: spraying, brushing, roller coating, doctor blade application, flow coating, etc in such a way as to produce an even and smooth coating of a dry thickness of 5 to 30 $\mu$m. In order to assist and accelerate solvent or water evaporation the blade can be passed through a hot air drying tunnel after which the coating becomes tack-free enabling winding up of the coated blade.

Step 3. The soft material composition is applied on top of the primer intermediate layer using a low (or high) pressure mixing and dosing machine capable of handling ultra-fast curing multicomponent resin systems with pot-lives as short as 5–30 seconds. The mixed resin components are poured directly from the mixing chamber onto the moving metallic substrate through a suitable nozzle.

During the 5–30 seconds of pot-life, the resin spreads out until it reaches the edge of the substrate or remains in the centre of the blade of double width depending on the positioning of the nozzle. After this very short time, viscosity increases due to the reaction of the components and prevents further spreading out or dripping off the substrate edge in the alternative of edge coating of a single width blade. By the time the applied resin reaches the winding up site it has hardened or cured to the extent of becoming elastic and tacky-free and the blade can be wound up using a spacer to avoid surface damage. The width and thickness of the applied ribbon is controlled by the flow rate and the linear velocity of the substrate, but depends also on the initial rheology and pot-life corresponding to the rate of viscosity increase of the formulation. The pot-life is controlled by the type and concentration of the curing catalyst.

Typically a width of 5–40 mm is achieved and a thickness of 1–3 mm, when using a flow rate of 0.25 to 1.5 kg/min and a linear speed of 1.5 to 10 m/min of the travelling band.

Step 4. In order to obtain optimal mechanical properties of the rubber-like composition thermal treatment is performed to further post-cure the material. This can be directly performed on the wound up blade of Step 3 by introducing same into a circulated air oven for 16–24 h at 80–85° C.

Step 5. Finally, the post-cured rubber-like deposit is ground to the desired shape and geometry, and the blades are cut to the desired dimensions. In the alternative case of a deposit on the substrate centre the blade is first longitudinally cut in two halves by means of a laser beam or any other cutting device.

Figure 2:
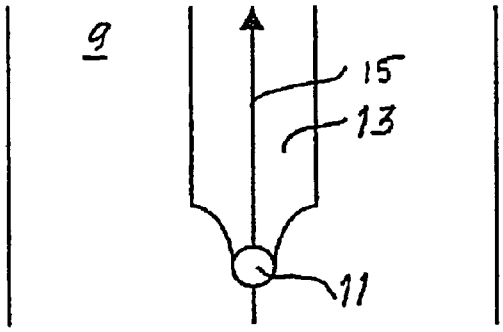
FIG. 2 is a corresponding view of the alternative procedure of simultaneous manufacture of two soft-tipped blades.
Figure 3:
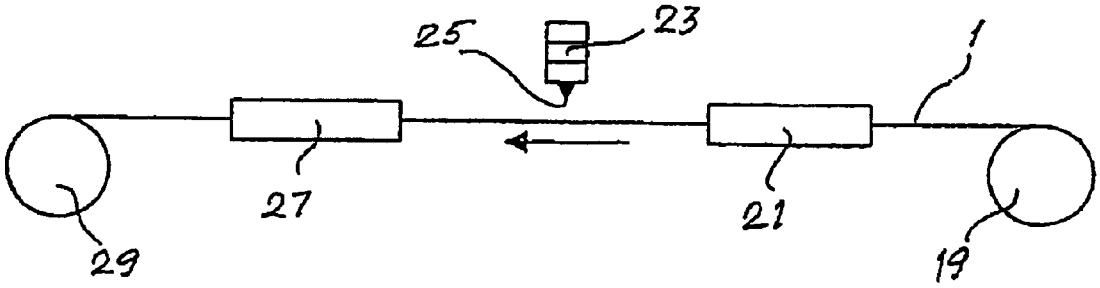
FIG. 3 is a diagrammatic side view of an assembly for performing the continuous process according to the invention.

The drawing illustrates diagrammatically the two alternatives of blade manufacture in FIGS. 1 and 2 and also a suitable machine set up for the continuous process in accordance with FIG. 3.

In FIG. 1 there is shown a travelling steel band 1 moving in the direction of arrow a). The resin nozzle 3 applies the resin composition which widens to the desired ribbon 5 reaching up to one edge of blade 1.

FIG. 2 shows the alternative of a simultaneous manufacture of two blades by using a blade 9 of double width and the application of a coating 13 of double width from an application nozzle 11. After curing of coating 13 the blade is longitudinally cut into two halves along line 15 by means of laser or any suitable cutting device.

FIG. 3 shows diagrammatically a side view of a machine assembly for performing the continuous process in accordance with the invention. A steel band 1 is supplied from a storage reel 19 and travels through a hot air tunnel for pre-heating and drying purposes. A mixing chamber 23 provided with an application nozzle 25 is placed above the travelling band 1 and applies a coating composition along the edge of band 1 as illustrated in FIG. 1. The coated band 1 further travels through a hot air tunnel for curing purposes and band 1 with the applied elastic and tacky-free coating is then wound up on a take-up reel 29 using a spacer to avoid surface damage and also to compensate for the coating thickness. The coated blade is then ground to the desired shape and geometry and the band is cut in desired lengths to meet the consumers need.

DESCRIPTION OF SPECIFIC EMBODIMENTS

The following examples further illustrate the invention by specific embodiments thereof. It should be noted, however, that the invention is not restricted to these examples.

EXAMPLE I a) Bonding Agent

A reel of cold rolled steel having a thickness of 0.635 mm, a width of 100 mm and a length of 30 m, is sand blasted on one side in an area forming a 3 cm wide longitudinal strip from one edge, using Edelkorund weiss (WSK) F 180. (Treibacher). The roughened surface area is coated in a continuous way with a bonding agent such as Chemosil 597 B (Henkel) used to promote adhesion of cast polyurethanes to steel. The bonding agent solution is applied without dilution by means of a 0.15 mm thick and 4 cm wide bent steel blade so as to cover the entire sand blasted area with a regular and smooth film of approximately 15 $\mu$m dry thickness. After evaporation of the solvent, the reel of coated steel is optionally cured in a circulated air oven at 85° C. for 2 hours.

b) PUR Top Coat

The liquid cast polyurethane composition used to coat the blade is applied on top of the bonding agent coated strip by means of a low pressure mixing and dosing machine equipped with a device allowing to inject a catalyst directly into the mixing chamber. The 3 component PUR is formulated to an ultra fast-curing composition by injecting a highly efficient catalyst solution directly into the mixing chamber. The composition is made up of an MDI (Polyester "quasi" prepolymer having an isocyanate content of 16.4% such as Ureflex® MDQ 23165 (Baulé), a Polyester Polyol Ureflex® D20 (Baulé) and a chain extender 1,4-Butanediol (Baulé), mixed in a ratio of 100:140:10.4 respectively. The catalyst solution Ureflex® SD6 (Baulé) is introduced directly into the mixing chamber at a rate of 2% of the total output of 0.25 kg/min, providing a pot-life of approximately 15 sec and a gel time of approximately 30 sec. The liquid mix is applied at 1 cm of the edge within the 3 cm wide bonding agent strip on the substrate moving at a linear speed of 3.3 nm/min. The moving substrate is wound up 4 m away from the pouring point, leaving enough time for the polyurethane to gelify and become tack-free, while using a spacer so as to prevent any surface damage of the applied Polyurethane elastomer during the winding up operation. The reel of wound up substrate and spacer is then submitted to a heat treatment in a circulated air oven at 85° C. for 24 h. After cooling down, the reel is unwound and shows no deformation of the metal substrate. The fully cured polyurethane elastomer strip has a shore A hardness of 70–73 (measured on the blade), a width of 3 cm and a thickness of 2.5 mm, obtained in one pass. Finally, the blades are ground in a continuous way to the final blade geometry and cut to the desired length.

EXAMPLE II

Example I is repeated using a steel band with a width of 200 mm, the area to be coated being centrally positioned and having a width of 6 cm. This area is treated and coated as described in Example I and the band is then laser cut along the middle of the coated area, and tip grinding is performed to the desired blade geometry.

The invention has been described above by specific examples and sequence of steps involved in the continuous process according to the invention. However, it is clear to the skilled artisan that the process can be modified in different ways without departing from the inventive concept according to the appended claims. All such modifications are intended to be covered by said claims.

We claim:

1. A process for the manufacture of a coating blade comprising a band of metal and a wear-resistant polymer coating applied on said band along a longitudinal edge section thereof subjected to wear, characterized by the following steps:

a) providing continuous relative movement between said band and an application and treatment station;

b) continuously applying at said station a fast curing polymer composition along said edge section;

c) allowing the applied composition to spread out so as to reach the very extreme of said edge section and then to cure to form an elastic and tacky-free coating; and, optionally d) post-curing the coating at an increased temperature.

2. A process according to claim 1, wherein said polymeric coating after curing is subjected to a grinding operation to obtain a desired profile.

3. A doctoring blade prepared by the process according to any one of the preceding claims.

4. A process according to claim 1, characterized by the application of a primer before application step b) to improve adhesion of the coating.

5. A process according to claim 1, wherein said fast-curing polymer composition has a pot-life of about 5 to 30 seconds.

6. A process according to claim 1, wherein said polymer composition is based on a polymer selected from polyurethanes, styrene-butadien polymers, polyolefins, nitrile rubbers, natural rubbers, polyacrylates, polychloroprene, thermoplastic elastomers, and polysiloxanes.

7. A process according to claim 6, wherein said polymer is a polyurethane.

8. A process according to claim 7, wherein a 3 component liquid polyurethane composition containing a prepolymer, a polyol and a chain extender is continuously mixed with a catalyst solution and the mixture is then applied onto said band.

9. A process according to claim 1, wherein said polymer is applied with a width of about 5 to 40 mm and a thickness of about 1 to 3 mm.

10. A process according to claim 1, characterized by roughening said edge before application step b) to improve adhesion of the coating.

11. A process according to claim 10, characterized by the application of a primer before application step b) to improve adhesion of the coating.

12. A process according to claim 10, wherein said fast-curing polymer composition has a pot-life of about 5 to 30 seconds.

13. A process according to claim 10, wherein said polymer composition is based on a polymer selected from polyurethanes, styrene-butadien polymers, polyolefins, nitrile rubbers, natural rubbers, polyacrylates, polychloroprene, thermoplastic elastomers, and polysiloxanes.

14. A process for the manufacture of a coating blade comprising a first band of metal and a wear-resistant polymer coating applied on said band along a longitudinal edge section thereof subjected to wear, characterized by the following steps:

a) providing continuous relative movement between a second band of double width compared to said first band and an application and treatment station;

b) continuously supplying at said station a fast-curing composition along a longitudinal central section of double width compared to said edge section;

c) allowing the applied composition to spread out to the desired width and then to cure to form an elastic and tacky-free coating and, optionally, post-curing the coating at an increased temperature; and d) longitudinally cutting said second band along the middle of the coated central section thereof to form two tip-coated blades.

15. A process according to claim 14, wherein said polymeric coating after curing is subjected to a grinding operation to obtain a desired profile.

16. A process according to claim 14, wherein said fast-curing polymer composition has a pot-life of about 5 to 30 seconds.

17. A process according to claim 14, wherein said polymer is applied with a width of about 5 to 40 mm and a thickness of about 1 to 3 mm.

18. A process according to claim 14, wherein said polymer composition is based on a polymer selected from polyurethanes, styrene-butadien polymers, polyolefins, nitrile rubbers, natural rubbers, polyacrylates, polychloroprene, thermoplastic elastomers, and polysiloxanes.

19. A process according to claim 14, characterized by the application of a primer before application step b) to improve adhesion of the coating.

20. A process according to claim 14, characterized by roughening said central section before application step b) to improve adhesion of the coating.

21. A process according to claim 20, characterized by the application of a primer before application step b) to improve adhesion of the coating.

* * * * *

UNITED STATES PATENT AND TRADEMARK OFFICE

CERTIFICATE OF CORRECTION

PATENT NO. : 6,733,834 B1
DATED : May 11, 2004
INVENTOR(S) : Günter Bellmann et al.

It is certified that error appears in the above-identified patent and that said Letters Patent is hereby corrected as shown below:

Title page,
Item [73], Assignee, delete "ETG Eclepens S.A." and insert -- BTG Eclepens S.A. --.

Signed and Sealed this

Seventh Day of December, 2004

JON W. DUDAS
*Director of the United States Patent and Trademark Office*